US007478945B2

(12) United States Patent
Damasko

(10) Patent No.: US 7,478,945 B2
(45) Date of Patent: Jan. 20, 2009

(54) WATCH CASE AND WRISTWATCH WITH SUCH A CASE

(76) Inventor: Petra Damasko, Toni-Pfulf-Weg 3, D-93055, Regensburg (DE)

( * ) Notice: Subject to any disclaimer, the term of this patent is extended or adjusted under 35 U.S.C. 154(b) by 0 days.

(21) Appl. No.: 12/216,473

(22) Filed: Jul. 7, 2008

(65) Prior Publication Data

US 2008/0273428 A1 Nov. 6, 2008

Related U.S. Application Data

(63) Continuation of application No. 11/358,712, filed on Feb. 22, 2006, now Pat. No. 7,413,339.

(30) Foreign Application Priority Data

Feb. 23, 2005 (DE) ..... 20 2005 003 029 U

(51) Int. Cl.
*G04B 37/00* (2006.01)

(52) U.S. Cl. ..... 368/294

(58) Field of Classification Search ..... 368/294, 368/295, 223

See application file for complete search history.

(56) References Cited

U.S. PATENT DOCUMENTS

| | | | | |
|---|---|---|---|---|
| 3,662,537 A | | 5/1972 | Fujimori | |
| 4,244,044 A | * | 1/1981 | Olsson | 368/291 |
| 4,420,264 A | | 12/1983 | Murata | |
| 5,122,997 A | * | 6/1992 | Schneider et al. | 368/294 |
| 5,654,941 A | | 8/1997 | Joss | |
| 6,010,241 A | | 1/2000 | Bulgari | |
| 6,599,009 B2 | * | 7/2003 | Terasawa et al. | 368/295 |
| 7,182,508 B2 | * | 2/2007 | Bertrand et al. | 368/295 |
| 2003/0099165 A1 | * | 5/2003 | Terasawa | 368/294 |

FOREIGN PATENT DOCUMENTS

| | | |
|---|---|---|
| CH | 503 306 | 8/1968 |
| CH | 685 087 | 10/1993 |
| DE | 26 35 324 | 8/1976 |
| DE | 32 34 405 | 9/1982 |
| EP | 0 744 673 | 5/1996 |
| EP | 0 770 937 | 10/1996 |
| EP | 1 416 341 | 9/2003 |
| WO | 95/24001 | 9/1995 |
| WO | 97/45775 | 12/1997 |
| WO | 02/44818 | 6/2002 |

* cited by examiner

*Primary Examiner*—Gary F. Paumen
(74) *Attorney, Agent, or Firm*—Hoffman, Wasson & Gitler

(57) ABSTRACT

A watchcase has a turning ring provided on one case surface and enclosing one case section. The turning ring is secured by at least one holding element engaging a peripheral groove of the case section and securing the turning ring to t case section.

1 Claim, 7 Drawing Sheets

FIG. 14
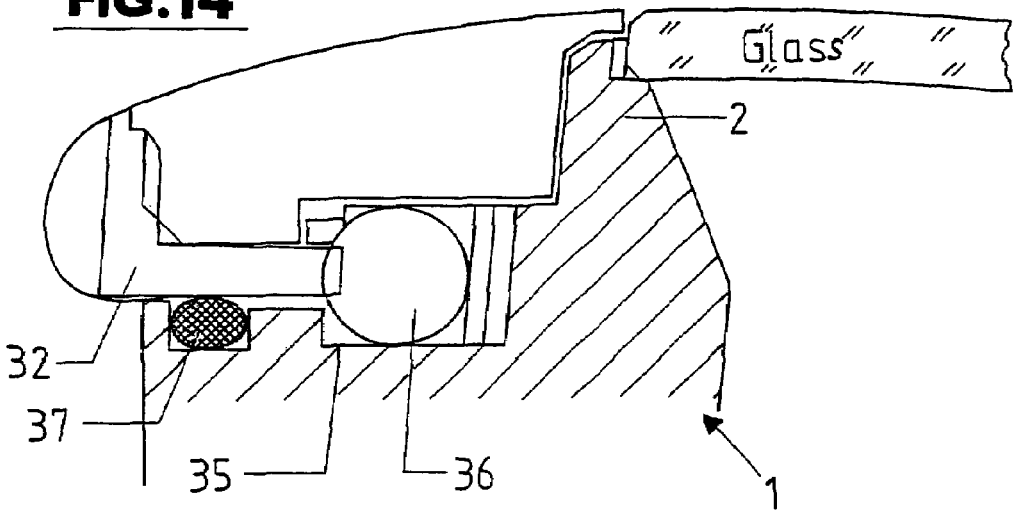
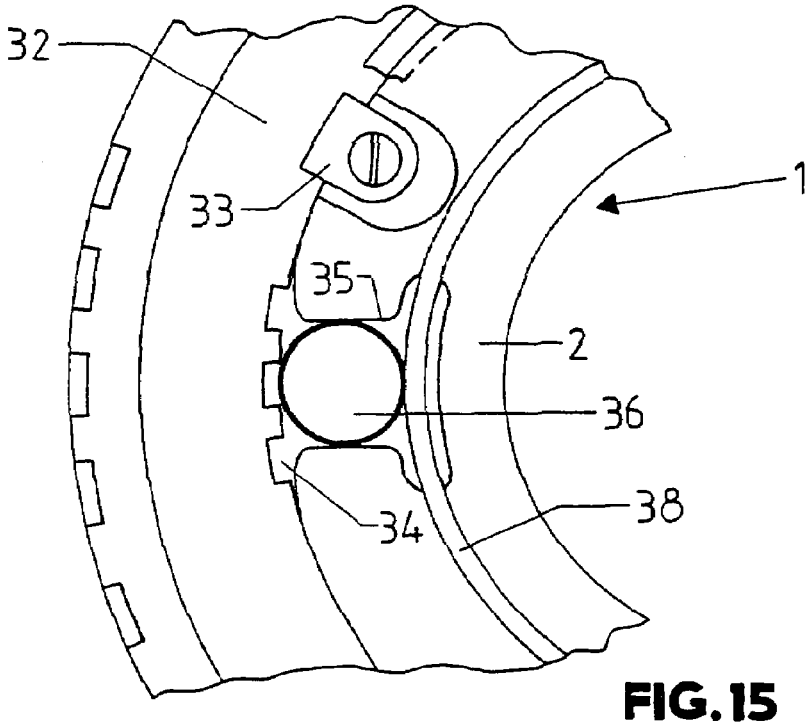
FIG. 15

WATCH CASE AND WRISTWATCH WITH SUCH A CASE

This application is a continuation of Ser. No. 11/358,712, filed Feb. 22, 2006 now U.S. Pat. No. 7,413,339.

BACKGROUND OF THE INVENTION

It is an object of the invention is to demonstrate a watch case with a turning ring, in which said turning ring can be rotated with a high degree of precision, practically with no play and with low wear, and in particular also in a locking manner, so that the means for turnable fastening of the ring on the watch case do not detract from the appearance of the watch.

SUMMARY OF THE INVENTION

The turning ring is secured in the watch case by providing at least one securing element, which engages in a peripheral groove of the section of the case used for mounting the turning ring and is simultaneously held or guided on the turning ring or bears against one surface of the turning ring, thus securing the turning ring against being inadvertently pulled off of the case section.

For turning of the turning ring in locking increments, at least one spring-action catch element is provided on the watch case or on the turning ring and said catch element works together with catches on the turning ring or on the watch case. Preferably several, for example three such catch elements are provided, located at regular angle intervals on the axis of the turning ring. The catch elements, at least on their surfaces that work together with the catches, are made of a high-strength material, for example of a ceramic material, e.g. silicon carbide. The watch case comprising the catches or the turning ring comprising the catches, at least in the area of said catches, are likewise made of a hard material, for example of a hardenable stainless steel, e.g. of a hardenable martensitic stainless steel or a steel of the following group: X55 CrMo 14, X65 CrMo 14, X90 CrMoV 18, X105 CrMo 17 and X110 CrMoV 15.

BRIEF DESCRIPTION OF THE DRAWINGS

The invention is described in more detail below based on exemplary embodiments with reference to the drawings, wherein:

FIGS. 14 and 15 show different views of further possible embodiments of the invention.

DETAILED DESCRIPTION OF THE INVENTION

Figure 1:
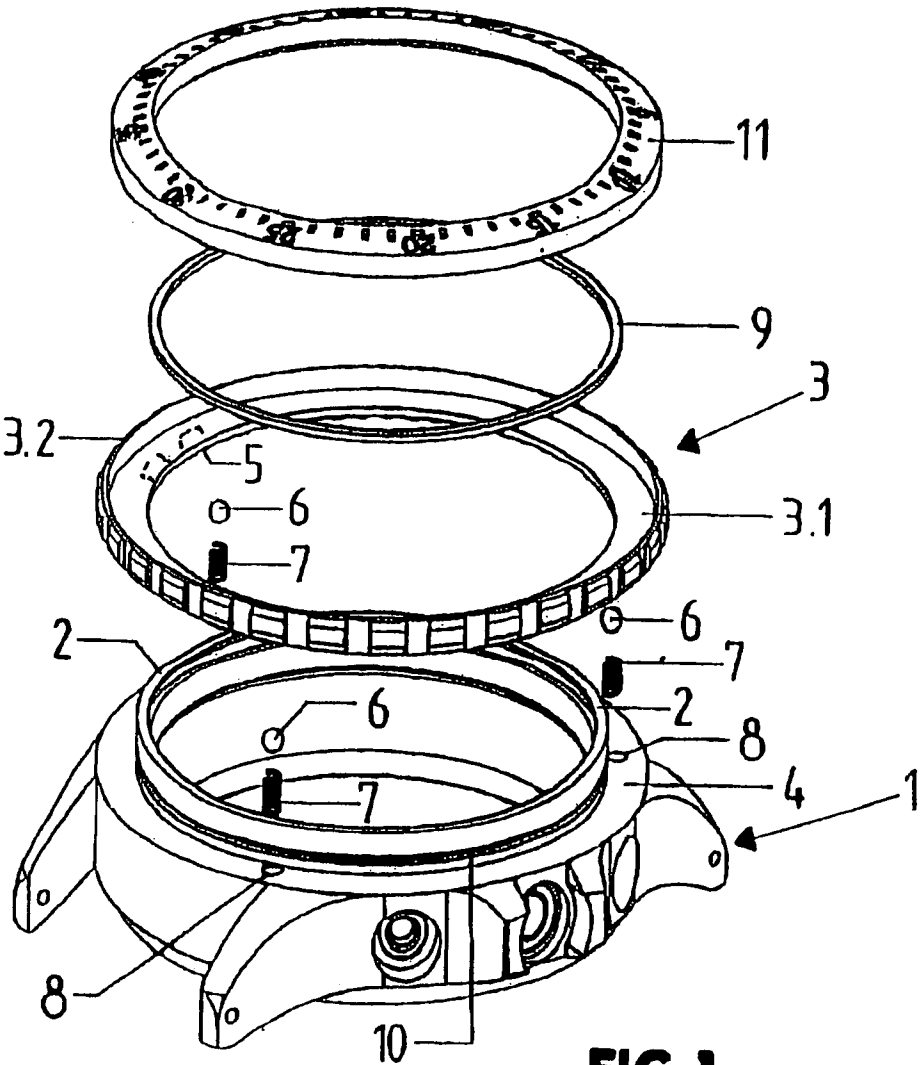
FIG. 1 shows an exploded view of a watch case for a wristwatch together with the elements of a turning ring provided on the top of the watch case.
Figure 2:
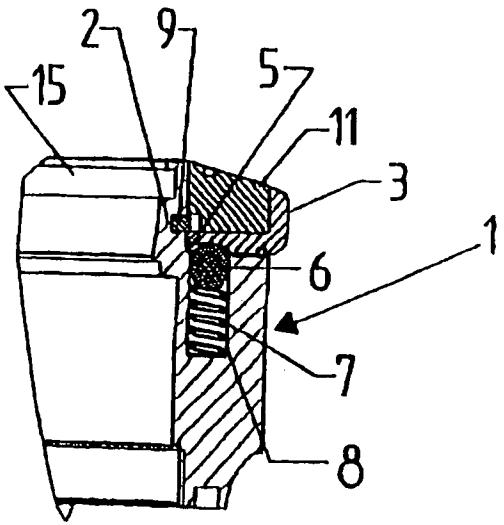
FIG. 2 shows a cross section of the watch case and the turning ring held on the watch case.

In FIGS. 1 and 2, the watch case of a wristwatch is generally designated 1. On the top the watch case 1 is provided as one piece with a ring-shaped extension or flange 2, on which a turning ring 3 is mounted turnably. The watch case 1 and the turning ring are preferably made of the hardenable steel specified above.

The turning ring 3, on its bottom side, with which it is adjacent to a ring surface 4 of the case 1 enclosing the flange 2 when mounted, is provided with grooves forming catches 5 and extending radially to the axis of the turning ring 3, which (grooves) when the turning ring 3 is mounted works together with spring-action ball catches on the watch case 1, so that the turning ring 3 can be turned in locking increments, for example in increments of 6°. The ball catches in the depicted embodiment each consist of one ball 6 made of a high-strength material, for example of a ceramic material, e.g. silicon carbide and of a spring 7. For holding each ball catch or the ball 6 and corresponding catch spring 7, bore holes 8 are made in the ring surface 4 and are oriented parallel to the axis of the turning ring 3. In the depicted embodiment, at regular angle intervals on the axis of the case 1 and of the turning ring 3, three such ball catches are provided, the balls 6 of which engage respectively in one catch groove 5 in each catch position of the turning ring 3, as depicted in FIG. 2.

For securing the turning ring 3 on the watch case 1, a snap ring 9 is provided and is made of a suitable spring steel and is slotted in the usual manner. When mounted, the snap ring 9 engages in a peripheral groove 10 of the flange 2 and bears with one outer peripheral area extending radially from the peripheral groove 10 against the top side of the turning ring 3 facing away from the watch case 1, namely along the inner edge of said turning ring.

The turning ring 3 in the depicted embodiment has an L-shaped cross section, i.e. it is manufactured as one piece with a ring section 3.1, which is located in a plane that is perpendicular to the ring axis, and with an outer section 3.2, which extends over the top side of the ring section 3.1 facing away from the watch case 1 and is knurled on the outside for a better grip on the turning ring 3.

After mounting of the turning ring 3 on the watch case 1, a turning ring insert 11 is inserted into the ring space formed between the flange 2 and the ring section 3.2 and is fastened to the turning ring 3 in a suitable manner, for example by being screwed on and/or glued on. The turning ring insert 11 is preferably designed so that after insertion of said ring, it forms a radial bearing surface for the snap ring 9, thus fixing the latter against radially slipping from the peripheral groove 10. On the truncated cone-shaped beveled top side, the turning ring insert 11 is provided with the gradation or scale typical of wristwatches with a turning ring.

Figure 3:
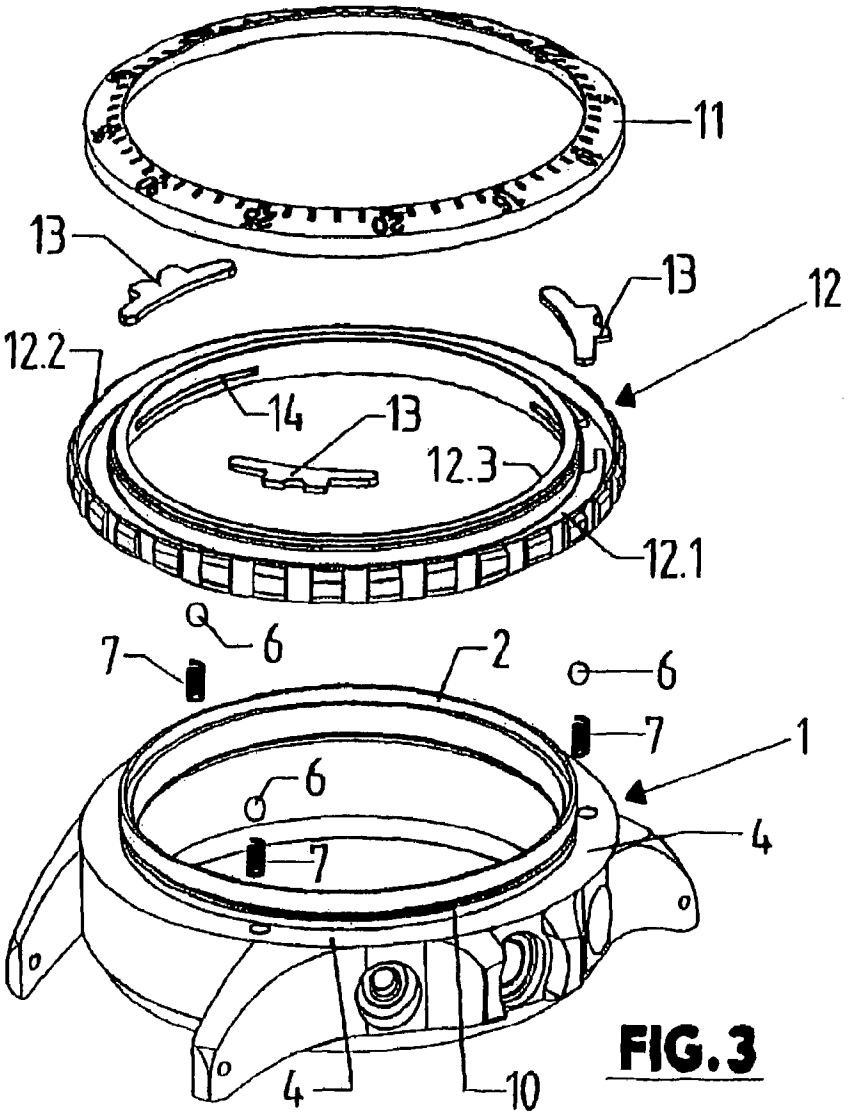
FIGS. 3 and 4 show views similar to FIGS. 1 and 2 of a further possible embodiment.
Figure 4:
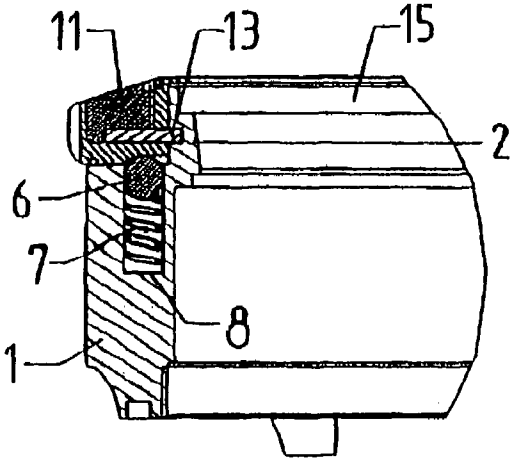

FIGS. 3 and 4 show as a further possible embodiment the watch case 1 together with a turning ring 12, which corresponds in its function to the turning ring 3, however it is not held with a snap ring 9 on the flange 2, but rather with a plurality, i.e. in the depicted embodiment with three flat ring retaining springs 13, which in the depicted turning ring 12 engage in the peripheral groove 10 of the flange 2. For this purpose the turning ring 12 is designed so that it forms on its top side facing away from the watch case 1 when mounted a groove-shaped recess concentrically enclosing the axis of the turning ring, i.e. comprising three ring sections, namely the ring section 12.1, which is located in a plane perpendicular to the axis of the turning ring 12 and comprises the catch grooves 5 on its bottom side facing the watch case 1, an outer ring section 12.2 extending over the top of the ring section 12.1 and likewise knurled for a better grip on the turning ring 12, and an inner ring section 12.3, likewise extending over the top of the ring section 12.1 and bearing with its inner side when the turning ring is mounted against the outer surface of the flange 2. Slots 14 are provided in the ring section 12.3 for each ring spring 13.

The elements are assembled so that before placing the turning ring 12 on the flange 2, a ring retaining spring 13 is mounted in each slot 14 and pressed radially outward until the concave side formed on the broader section of each ring retaining spring 13 is flush with the cylindrical inner surface of the ring section 12.3. After placing the turning ring 12, the ring retaining springs 13 are pressed on their narrower side extending into the groove of the turning ring 12 radially inward using a suitable tool, so that each ring retaining spring 13 then projects over the inner surface of the ring section 12.3 and extends into the peripheral groove 10. Assembly is completed by inserting the turning ring insert 11 into the ring groove of the turning ring 12. The turning ring insert 11 in this embodiment is designed so that it simultaneously secures the ring retaining springs 13 in their position engaging in the peripheral groove 10. The turning ring insert 11 is fastened by being screwed in or glued in. An additional special feature of this embodiment is the fact that the ring section 12.3 of the turning ring 12 overlaps the flange 2 on its free upper edge and also the edge area of the watch crystal 15 held in said flange.

Figure 5:
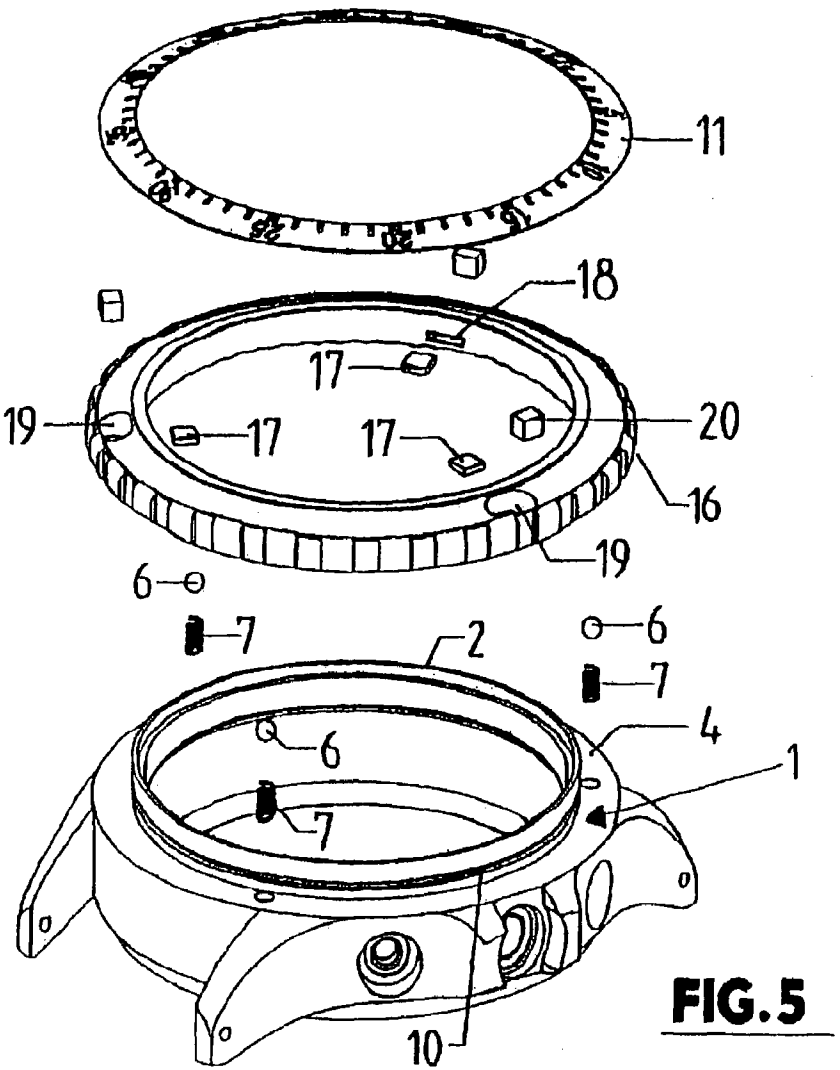
FIG. 5 shows an exploded view of the watch case and the elements of a turning ring in a further embodiment.
Figure 6:
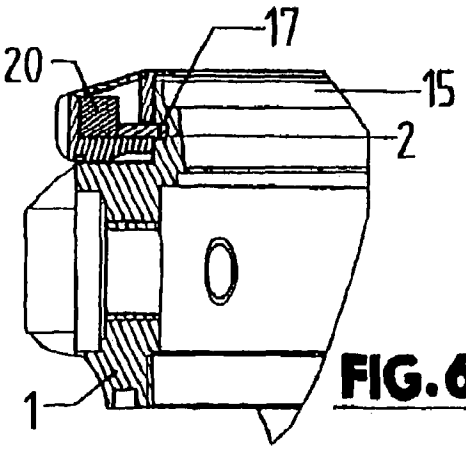
FIGS. 6 and 7 show cross sections of the watch case and the turning ring.
Figure 7:
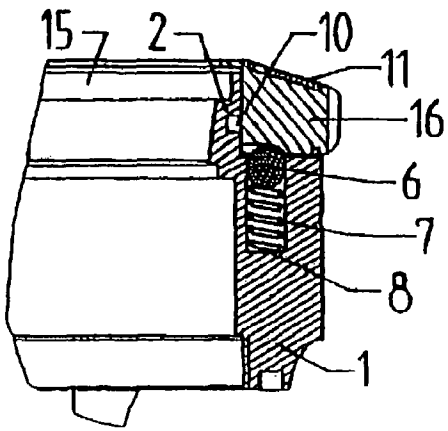

FIGS. 5-7 show as a further possible embodiment the watch case 1 with a turning ring 16 which differs from the turning ring 12 essentially only in that three sliding plates 17 are provided instead of the three ring retaining springs 13 for holding the turning ring 16. Each sliding plate 17 is allocated to one open slot 18 on the inner side of the turning ring 16, said slot leading into an open recess 19 on the top of the turning ring 16. For the assembly of the turning ring 16, one sliding plate 17 is inserted into one slot 16 respectively, so that the sliding plate does not protrude beyond the cylindrical inner surface of the turning ring 16. After placing the turning ring 16 on the flange 2, a suitable tool is used to push the sliding plate 17 radially inward, so that it is partially held in the slot 16 and partially protrudes from said slot 16 into the peripheral groove. Each sliding plate 17 is secured in this position by one insert 20 inserted suitably into the recess 19. The recesses 19 are then closed by the turning ring insert 11, which is likewise connected with the turning ring 16 in a suitable manner, for example by gluing.

Figure 8:
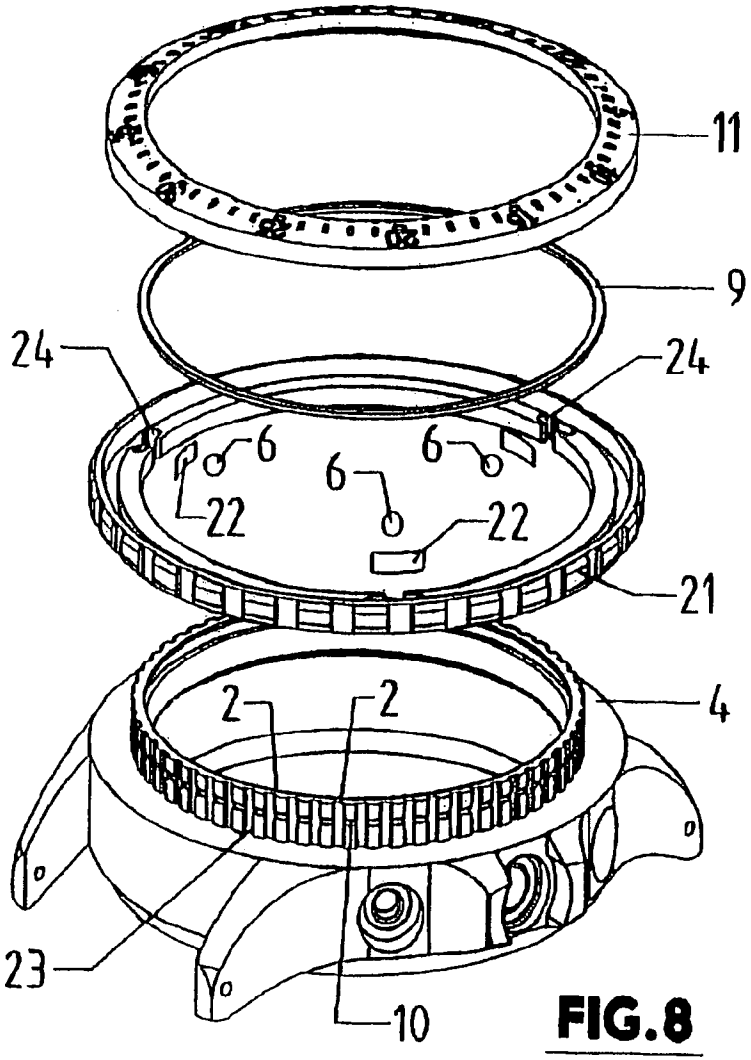
FIGS. 8 and 9 show views similar to FIGS. 1 and 2 of a further possible embodiment.
Figure 9:
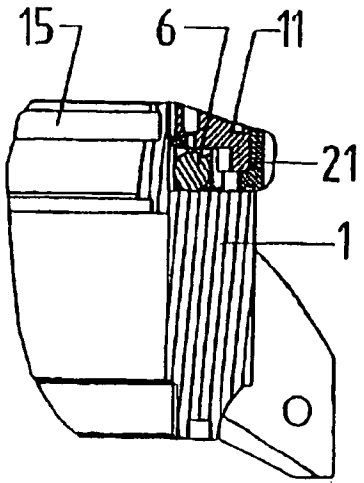

While in the embodiments of FIGS. 1-7 the ball catches formed by the balls 6 and the catch springs 7 work together with catch grooves 5 on the bottom of the respective turning ring 3, 12 or 16 and therefore the forces exerted by the ball catches onto the turning ring 3, 12 or 16 are parallel to the axis of the turning ring, FIG. 8 shows as a further embodiment a turning ring 21, in which the forces of the ball catches formed by the balls 6 and one respective spring plate 21 are exerted axially to the axis of the turning ring 21 and the ball catches formed by the balls 6 and the spring plates 22 are provided not on the watch case 1, but on the turning ring 21.

The flange 2 of the case 1 in this embodiment is provided in addition to the peripheral groove 10 with a plurality of catch grooves 23 extending parallel to the flange axis and the turning ring axis, which (catch grooves) likewise feature the angle interval corresponding to the division of the turning ring insert 11. The turning ring 21 is provided on the inside with recesses 24, each of which serves to hold one ball 6 and one pre-tensioning spring plate 22 pressing the ball 6 radially inward. For securing the turning ring 21 on the flange 2, the snap ring 9 is again used, which when mounted is located above the ball catches formed by the balls 6, i.e. is at a distance form the ring surface 4 of the case 1, while the balls 6 are guided on said ring surface. The snap ring 9, and also the turning ring insert 11 secure the balls 6 and the corresponding spring plates 22 on the top side of the turning ring 21 facing away from the watch case 1.

Figure 10:
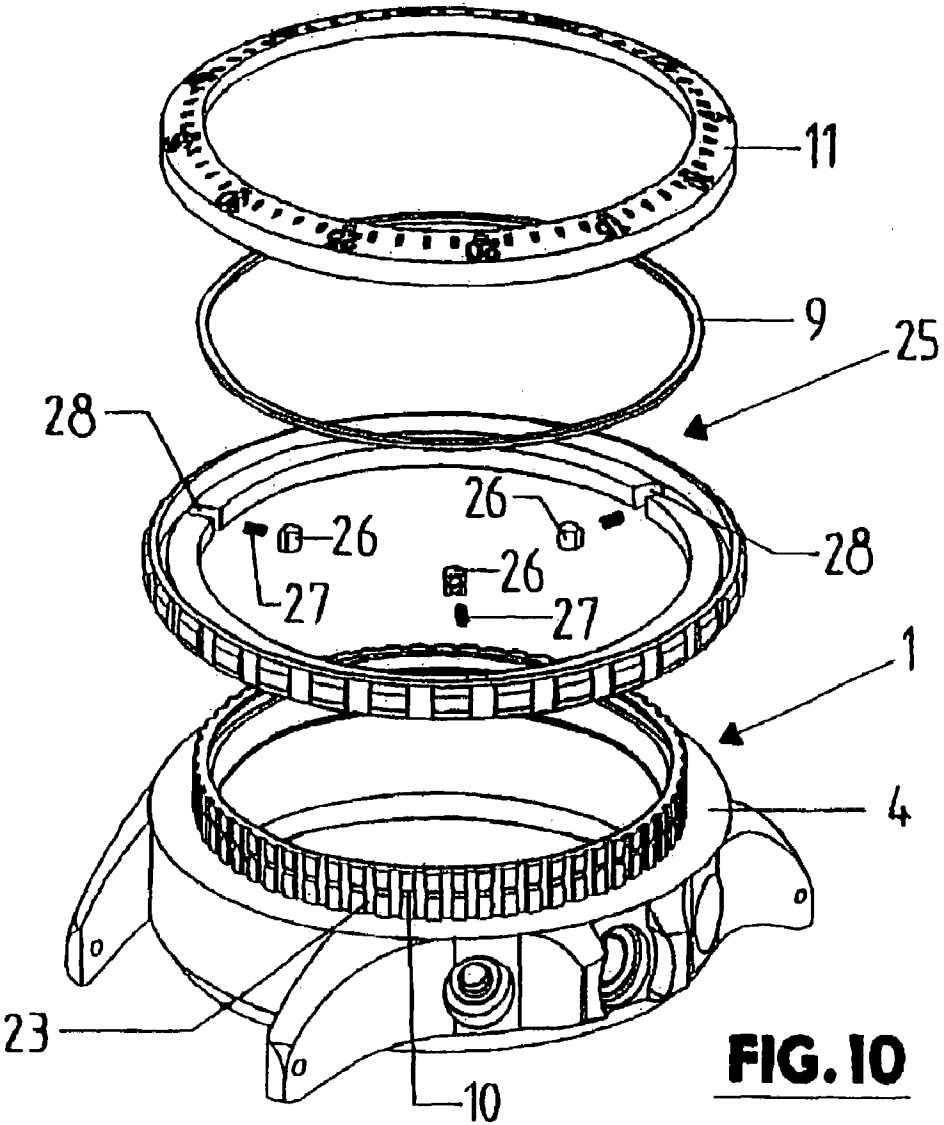
FIGS. 10-13 show views similar to FIGS. 1 and 2 of a further possible embodiment.
Figure 11:
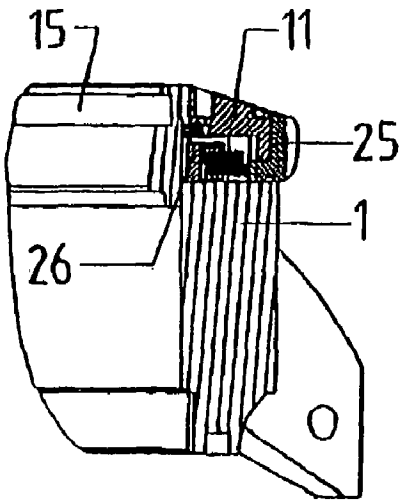

FIGS. 10 and 11 show as a further possible embodiment a turning ring 25, which differs from the turning ring 21 essentially only in that three catch elements 26 offset by 120° and with corresponding springs 27 are provided instead of the ball catches formed by the balls 6 and the spring plates 22. For each catch element, a recess 28 is formed on the inside of the turning ring, so that the respective catch element 26 is held in its recess 28 so that it can slide radially against the spring 27. The turning ring 25 is again secured by the snap ring 9. After mounting said snap ring and in particular also the turning ring insert 11, the recesses 28 are closed on the one hand by the ring surface 4 of the case 1 and on the other hand by the snap ring 9 and the turning ring insert 11, so that the catch elements 26 with their springs 27 are secured in said recesses.

Both the balls 6 and the catch elements 26 are made of a high-strength material, for example of ceramic, e.g. silicon carbide.

Figure 12:
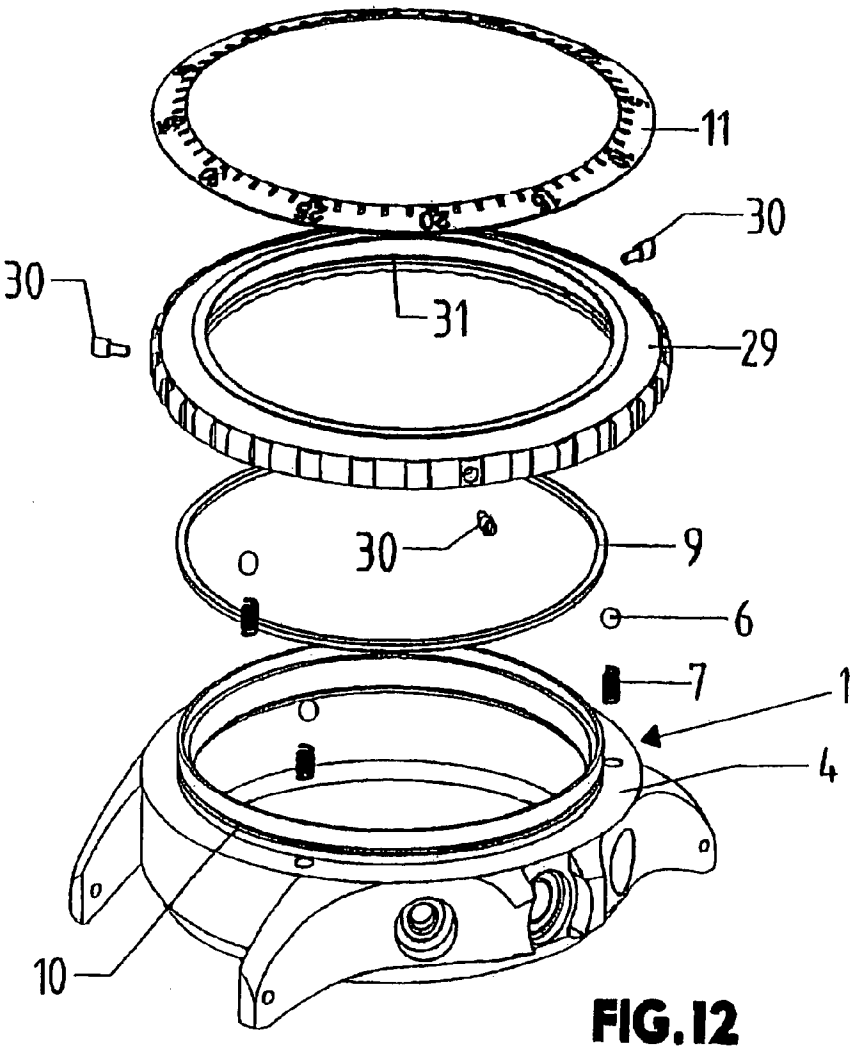
Figure 13:
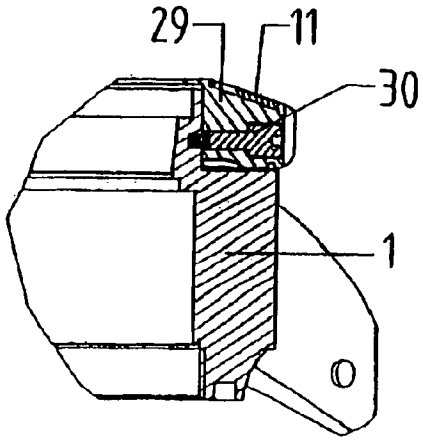

FIGS. 12 and 13 show as a further embodiment a watch case 1 with a turning ring 29, which is secured on the flange 2 by means of a divided snap ring 9, which is held in a groove 31 of the turning ring. After placing the turning ring 29, pre-mounted with the snap ring 9, on the flange 2, the snap ring 9 is pressed by means of radial screws 30 into the peripheral groove 10, so that it is then held partially in the peripheral groove 10 and partially in the groove 31.

FIGS. 14 and 15 show in a partial representation in a vertical cross section similar to FIG. 2 and in a horizontal cross section, as a further possible embodiment a watch case 1 with a turning ring 32, which encloses a case section 2 of the watch case and which is axially secured on the watch case 1 by several plates 33 that are screwed onto the watch case and overlap the turning ring 32. The turning ring 32 is provided on one inner surface with a plurality of catches 34 in the form of groove-shaped recesses with ridges in between, which work together with several spring-action catch elements in the form of balls 36 held in recesses 35 of the case flange, so that the turning ring 32 can be turned in increments. The transition between the turning ring 32 and the watch case is sealed by a sealing or sliding ring 37, for example a PTFE-coated sliding ring.

The spring force pressing the ball 36 radially outward against the catch 34 is produced by one common circular spring plate 38 for all balls 36. Instead of the circular spring plate 38, separate spring plates or springs, e.g. leaf springs, can also be provided for each ball 36.

Instead of the balls 36, flat disks can also be used that are then oriented with their surface sides parallel to the top and bottom of the watch case 1, the peripheral surface working together with the catches 34. The spring tension for pressing the disks is again produced by one common spring plate 38 or leaf spring element for all disks or by single spring elements, for example leaf springs, which can have a wide variety of forms. The use of disk-shaped spring-action catch elements instead of balls 36 has the advantage, among other things, of a very flat design.

Furthermore, in the embodiment of FIGS. 14 and 15 it is also possible again to axially secure the turning ring 32 for example by means of securing or holding elements, as described above in connection with FIGS. 1-13, for example using the snap ring 9 or a snap ring corresponding to said ring.

When completely assembled, a turning ring insert 38 corresponding to the turning ring 11 is fastened to the turning ring 32, for example by being glued in, screwed in, etc., said turning ring insert 38 in this embodiment again being covered by the spring-action catch elements formed by the balls 38 or the corresponding disks, and also the elements for axially fixing the turning ring on the watch case, namely the plates 33.

The invention was described above based on various exemplary embodiments. It goes without saying that numerous modifications and variations are possible without abandoning the underlying inventive idea upon which the invention is based.

| Reference list | |
|---|---|
| 1 | wristwatch case |
| 2 | case flange |
| 3 | turning ring |
| 3.1, 3.2 | ring section |
| 4 | ring surface on watch case 1 |
| 5 | catch groove |
| 6 | ball |
| 7 | catch spring |
| 8 | bore hole |
| 9 | snap ring |
| 10 | peripheral groove |
| 11 | turning ring insert |
| 12 | turning ring |
| 12.1, 12.2, 12.3 | ring section |
| 13 | ring retaining spring |
| 14 | slot |
| 15 | watch crystal |
| 16 | turning ring |
| 17 | sliding plate |
| 18 | slot |
| 19 | recess |
| 20 | safety catch or insert |
| 21 | turning ring |
| 22 | spring plate |

-continued

| Reference list | |
|---|---|
| 23 | catch groove |
| 24 | recess |
| 25 | turning ring |
| 26 | catch element |
| 27 | spring |
| 28 | recess |
| 29 | turning ring |
| 30 | screw |
| 31 | groove |
| 32 | turning ring |
| 33 | plate |
| 34 | catch |
| 35 | recess |
| 36 | ball or spring-action catch element |
| 37 | sliding ring |
| 38 | turning ring insert |

I claim:

1. A watch case comprising a turning ring mounted on a case surface and enclosing a case section, at least one securing element engaging in a peripheral groove of the case section and securing the turning ring on the case section, the securing element being partially located in a recess of the turning ring and engaging in the peripheral groove with a section protruding beyond an inner side of the turning ring, and at least one insert element that can be inserted into the turning ring for closing the recess of the turning ring.

* * * * *